US007653970B1

(12) United States Patent
Lai

(10) Patent No.: US 7,653,970 B1
(45) Date of Patent: Feb. 2, 2010

(54) DETACHABLE HAND TOOL

(76) Inventor: Jin-Tsai Lai, 12F-4, No.666, Sec.2, Wuquan W. Rd., Nantun District, Taichung City (TW) 40878

( * ) Notice: Subject to any disclaimer, the term of this patent is extended or adjusted under 35 U.S.C. 154(b) by 0 days.

(21) Appl. No.: 12/355,735

(22) Filed: Jan. 16, 2009

(51) Int. Cl.
*B25G 3/32* (2006.01)

(52) U.S. Cl. ..... 16/422; 16/DIG. 41; 81/489; 403/327

(58) Field of Classification Search ..... 16/422, 16/110.1, 427, DIG. 41; 81/489; 74/543; 403/327, 329
See application file for complete search history.

(56) References Cited

U.S. PATENT DOCUMENTS

| | | | | | |
|---|---|---|---|---|---|
| 4,466,377 | A * | 8/1984 | Kolb et al. | ..... | 16/422 |
| 4,829,857 | A * | 5/1989 | Jones | ..... | 81/177.1 |
| 5,581,845 | A * | 12/1996 | Yang | ..... | 16/421 |
| 5,809,615 | A * | 9/1998 | Schneider et al. | ..... | 16/427 |
| 6,669,397 | B1 * | 12/2003 | Christion | ..... | 403/322.2 |
| 2008/0313858 | A1 * | 12/2008 | Blom | ..... | 16/427 |

* cited by examiner

*Primary Examiner*—William L. Miller

(57) ABSTRACT

A detachable hand tool includes a handle, a spindle partially received in one end of the handle, a cap partially received in the other end of the handle, a casing sleeved on the spindle, a head sleeved on the casing, a tool driver partially and detachably mounted in the spindle, and a control assembly mounted on the spindle for detaching the tool driver.

7 Claims, 7 Drawing Sheets

DETACHABLE HAND TOOL

BACKGROUND OF THE INVENTION

1. Field of the Invention

The present invention relates to a hand tool, and more particularly to a detachable hand tool.

2. Description of Related Art

A conventional detachable hand tool in accordance with the prior art includes a hollow casing, a spindle received in the casing, a locking member disposed between the casing and the spindle to be relatively driven by the casing. The spindle has an end having a connecting portion defined therein. The connecting hole has a spring received therein and a block mounted on the spring. The block has a protrusion formed thereon. A tool driver is detachably received in the connecting hole. The block and the spring are pressed by the tool driver. A first end of the locking member is protruded from the connecting hole for allowing the tool driver extending in the connecting hole due to block pushed the locking member. When the block is pressed to a terminal of the connecting hole, the protrusion of the block presses a second end of the locking member for seesawly receiving the first end of the locking member for locking the tool driver. When the second end of the locking member is pressed, the first end of the locking member is seesawly protruded from the connecting hole for releasing the tool driver from the connecting hole.

However, the tool driver detached from the conventional detachable handle tool is easily shot off due to an elastic force of the spring. When the tool driver is released from locking, the compressed spring is released and shoots the tool driver. It is dangerous for a neighboring person to be shot by the tool driver. Furthermore, a speed of the tool driver shot by the conventional handle is fast such that the tool driver is easily lost.

The present invention has arisen to mitigate and/or obviate the disadvantages of the conventional detachable hand tool.

SUMMARY OF THE INVENTION

The main objective of the present invention is to provide an improved detachable hand tool.

To achieve the objective, the detachable hand tool in accordance with the present invention comprises a hollow handle. A spindle is partially received in the handle. The spindle has a groove longitudinally defined therein and a hole longitudinally defined therein adjacent to the groove. The spindle has a first recess laterally defined therein and being adjacent to the first end thereof. The first recess has two pivot holes respectively defined in two inner lateral sides thereof. The spindle has a second recess laterally defined therein adjacent to the second end thereof. Two cylindrical supporters are disposed between the first recess and the second recess. A control assembly is mounted on the spindle. The control assembly includes an elastic clamp simultaneously transversely mounted on the two supporters, a seesaw received in the first recess and extending to the second recess, a spring compressively received in the hole in the spindle, a shank mounted on the spring, and a button mounted on the shank and the seesaw. The clamp has a M-shaped structure crossly covered the two supporters and two distal ends of the clamp positioned under two supporters. The seesaw is mounted on the clamp and has a bottom abutted against a top of the clamp. One end of the seesaw has two pivots disposed on two sides thereof for correspondingly receiving in the two pivot holes in the first recess and the other end of the seesaw has a protruder formed thereon. A bottom of the button is abutted against the protruder of the seesaw. The button has a slant surface formed on the bottom thereof. The shank has a first end having a slope complementally abutted against the slant surface of the button and a second end selectively protruded from the hole. A casing is sleeved on the second end of the spindle. A head has one end longitudinally movably sleeved on the casing and the other end abutted against the tool driver. A tool driver has a neck formed thereon for corresponding to the clamp. The tool driver adapted to be detachably plugged into the groove in the spindle and the neck locked by the clamp.

When the button is slightly pressed in a first position, the seesaw is relatively pressed by the button and the seesaw is relatively abutted against the clamp. The clamp is elastic deformed such that the two distal ends of the clamp are outwardly moved relative to each other for releasing the neck of the tool driver. The tool driver in the first position is detachable for preventing the tool driver from shooting due to an elastic force of the spring.

When the button is deeply pressed in a second position, the slant surface of the button is relatively abutted against the slope of the shank such that shank is protruded from the hole for abutting against the head. The head is longitudinally moved relative to the casing and relatively abutted against the tool driver for detaching the neck form the clamp in auxiliary. The tool driver is slightly protruded from the handle. Therefore, the user can easily detach the tool driver and replace a new one.

Further benefits and advantages of the present invention will become apparent after a careful reading of the detailed description with appropriate reference to the accompanying drawings.

DETAILED DESCRIPTION OF THE INVENTION

Figure 1:
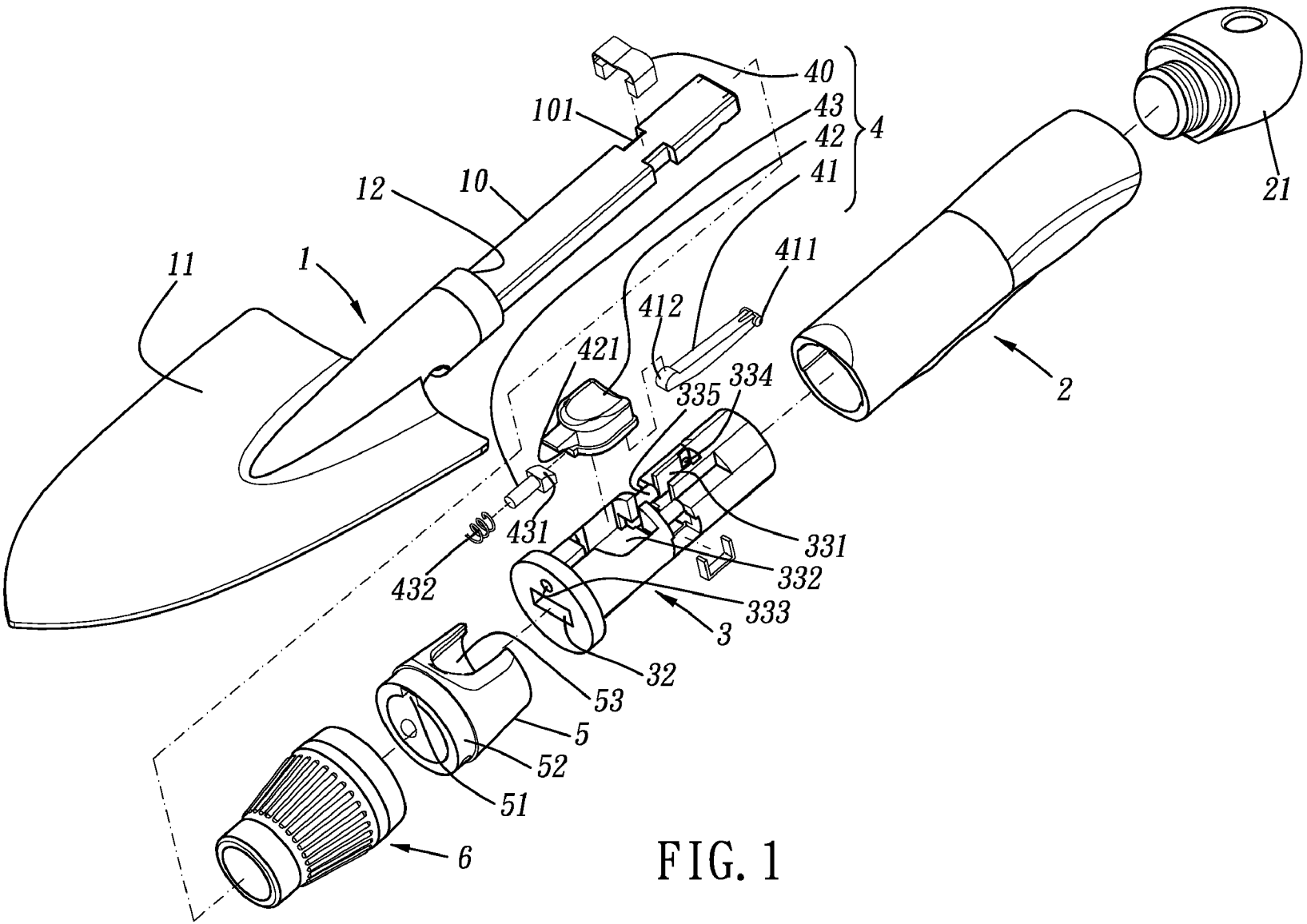
FIG. 1 is an exploded perspective view of a detachable hand tool in accordance with the present invention.
Figure 2:
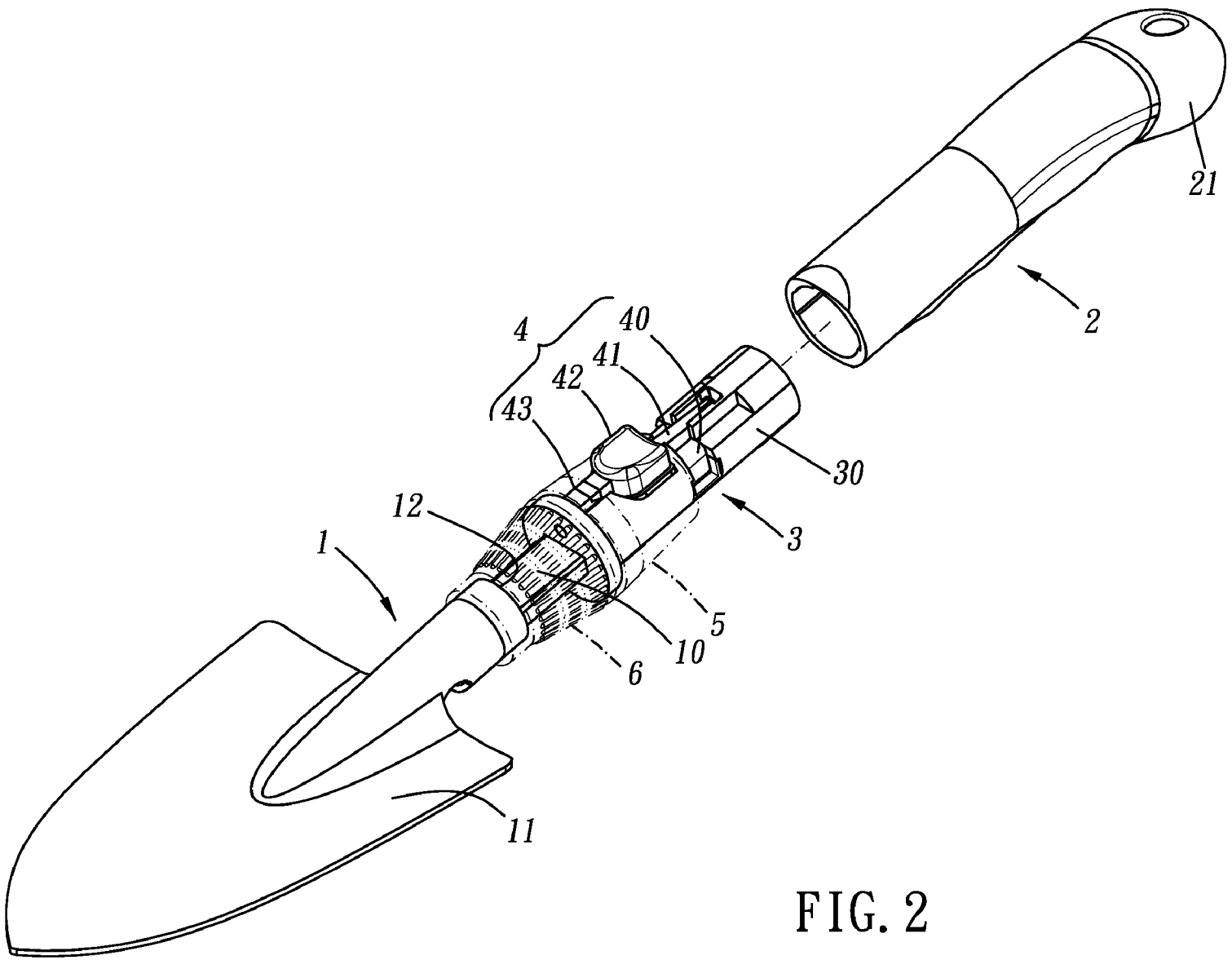
FIG. 2 is a partial exploded perspective view of the detachable hand tool in accordance with the present invention.
Figure 3:
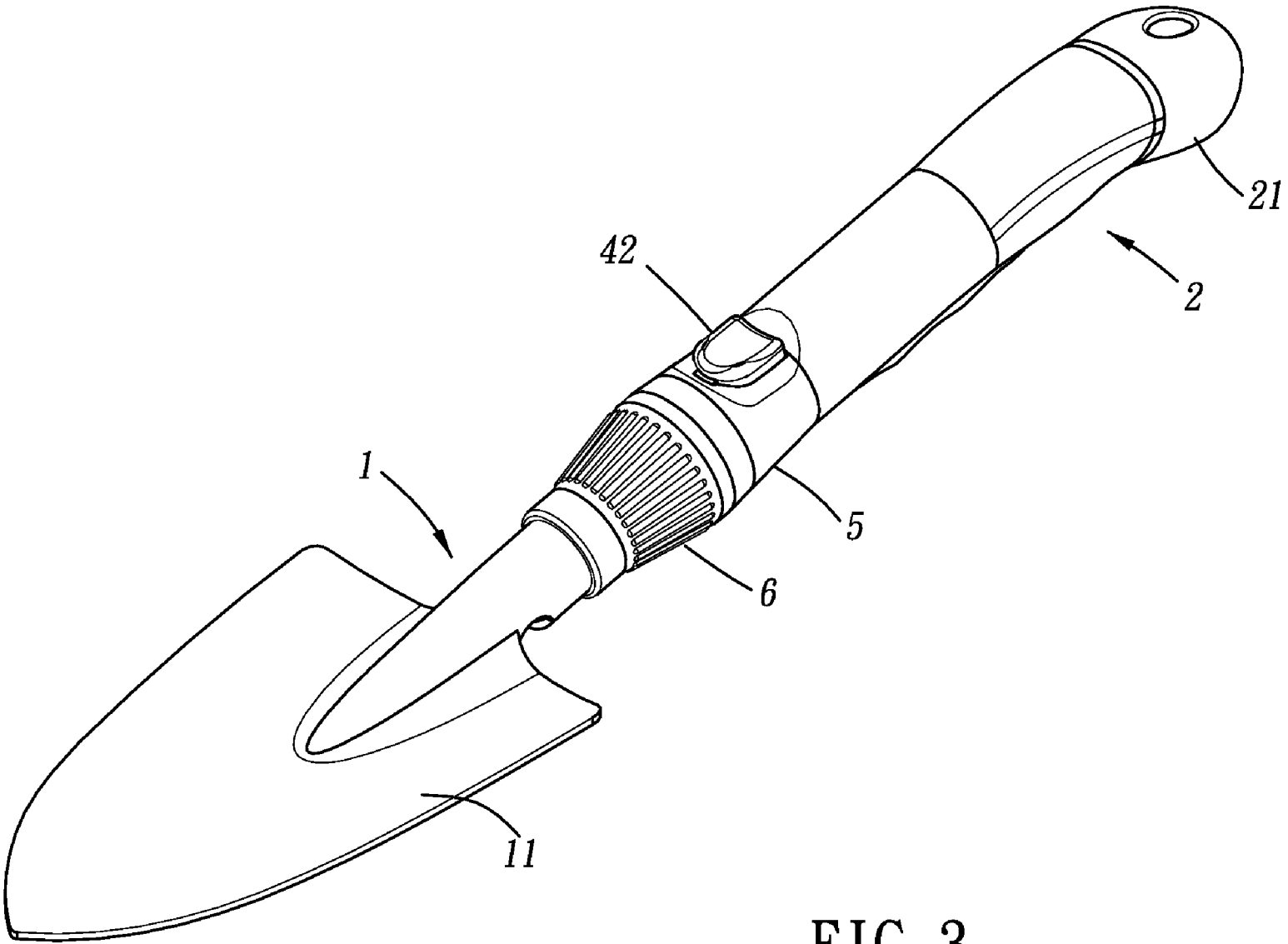
FIG. 3 is an assembled perspective view of the detachable hand tool in accordance with the present invention.

Referring to the drawings and initially to FIGS. 1-3, a detachable hand tool in accordance with the present invention comprises a handle 2, a spindle 3 partially received in one end of the handle 2, a cap 21 partially received in the other end of the handle 2, a casing 5 sleeved on the spindle 3, a head 6 sleeved on the casing 5, a tool driver 1 partially and detachably mounted in the spindle 3, and a control assembly 4 mounted on the spindle 3 for detaching the tool driver 1.

The spindle 3 has a first end partially received in the handle 2 and a second end partially received in the casing 5. The first end of the spindle 3 is opposite to the second end of the spindle 3. The spindle 3 has a groove 32 longitudinally defined therein. The spindle 3 has a hole 333 longitudinally defined therein and being adjacent to the groove 32. The spindle 3 has a first recess 331 laterally defined therein and being adjacent to the first end thereof. The first recess 331 has two pivot holes 334 respectively defined in two inner lateral sides thereof. The spindle 3 has a second recess 332 laterally defined therein and being adjacent to the second end thereof. The first recess 331 is communicated with the second recess 332. The hole 333 is communicated with the second recess 332. Two cylindrical supporters 335 are disposed between the first recess 331 and the second recess 332.

The control assembly 4 includes an elastic clamp 40 simultaneously transversely mounted on the two supporters 335, a seesaw 41 received in the first recess 331 and extending to the second recess 332, a spring 432 compressively received in the hole 333 in the spindle 3, a shank 43 mounted on the spring 432, and a button 42 mounted on the shank 43 and the seesaw 41. The clamp 40 has two arc portions formed on the interior thereof to form a M-shaped structure. The M-shaped structure of the clamp 40 transversely covers the two supporters 335 such that the two supporters 335 are respectively abutted against the two arc portions of the clamp 40. Two distal ends of the clamp 40 are positioned under the two supporters 335. The seesaw 41 is mounted on the clamp 40 and positioned between the two supporters 335. The seesaw 41 has a bottom abutted against a top of the clamp 40. One end of the seesaw 41 has two pivots 411 disposed on two sides thereof and the other end of the seesaw 41 has a protruder 412 formed thereon. The two pivots 411 are correspondingly received in the two pivot holes 334 in the first recess 331. The button 42 is partially received in the second recess 332 and mounted on a top of the other end of the seesaw 41. A bottom of the button 42 is abutted against the protruder 412 of the seesaw 41. The button 42 has a slant surface 421 formed on the bottom thereof. The shank 43 mounted on the spring 432 and partially received in the hole 333 from the second recess 332. The shank 43 has a first end having a slope 431 complementally abutted against the slant surface 421 of the button 42 and a second end selectively protruded from the hole 333.

The casing 5 is sleeved on the second end of the spindle 3. A cutout 53 laterally defined in of one end of the casing for receiving the button 42. The other end of the casing 5 has a shoulder 52 annularly formed on an outer periphery thereof for movably connecting to the head 6. The other end of the casing 5 has a slot 51 longitudinally defined therein for receiving the second end of shank 43 protruded from the hole 333 in the spindle 3.

The head 6 has one end longitudinally movably sleeved on the shoulder 52 of the casing 5 and the other end abutted against the tool driver 1. The second end of the shank 43 is selectively abutted against an inner periphery of the head 6 for relatively push the tool driver 1.

The tool driver 1 has a driving head 11 and a shaft 10 extending from the driving head 11. In the preferred embodiment of the present invention, the driving head 11 is a shovel. The shaft 10 of the tool driver 1 has a neck 101 formed thereon. The tool driver 1 has a shoulder 12 formed between the driving head 11 and the shaft 10.

When assembling, the first end of the spindle 3 is received in the handle 2 and the second end of the spindle 3 is sleeved by the casing 5. The head 6 is sleeved on the shoulder 52 of the casing 5. The tool driver 1 is plugged into the groove 32 in the spindle 3 via the head 6 and the casing 5. The shoulder 12 of the tool driver 1 is abutted against head 6. The neck 101 of the tool driver 1 is locked by the clamp 40 for fixing the tool driver 1 assembled in the spindle 3.

Figure 4:
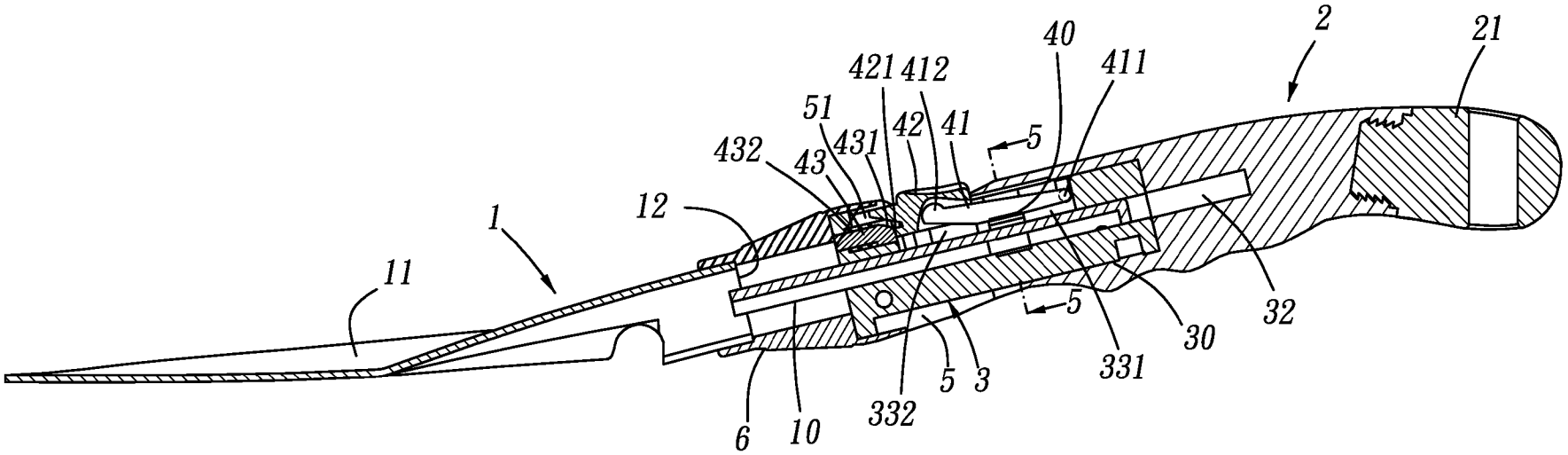
FIG. 4 is a side plane cross-sectional view of the detachable hand tool in an original position in accordance with the present invention.
Figure 5:
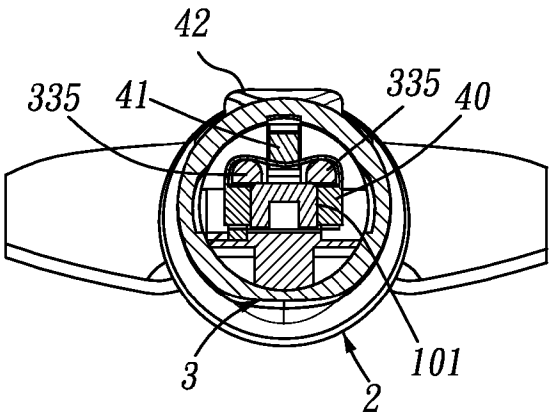
FIG. 5 is a cross-sectional view of the detachable hand tool of the present invention along line 5-5 in FIG. 4.
Figure 6:
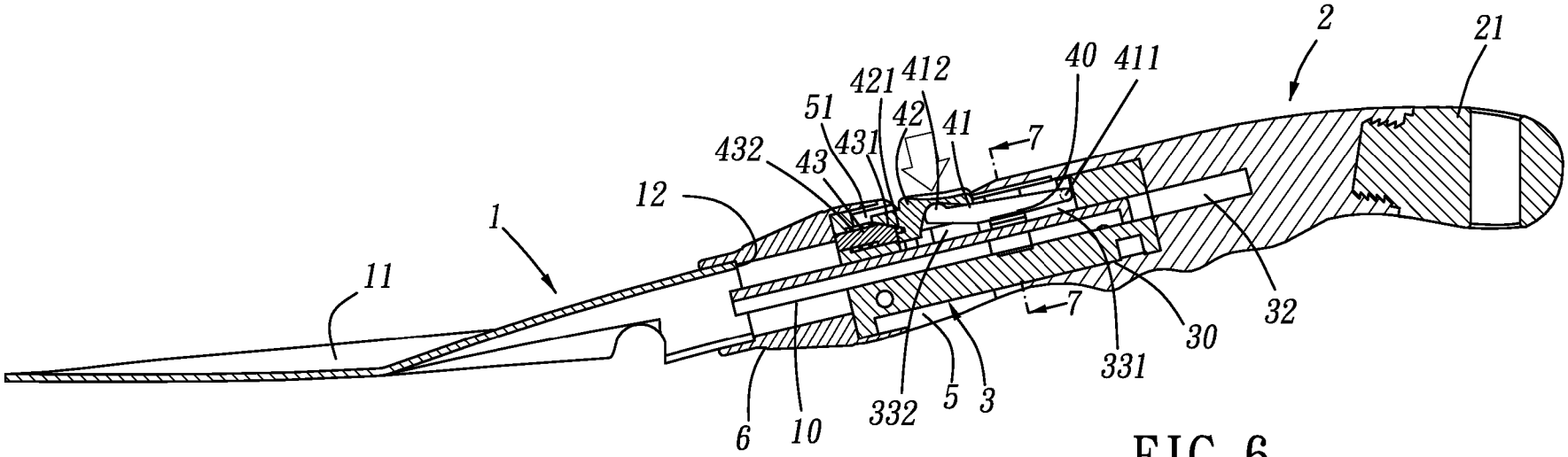
FIG. 6 is a side plane cross-sectional view of the detachable hand tool in a first position in accordance with the present invention.
Figure 7:
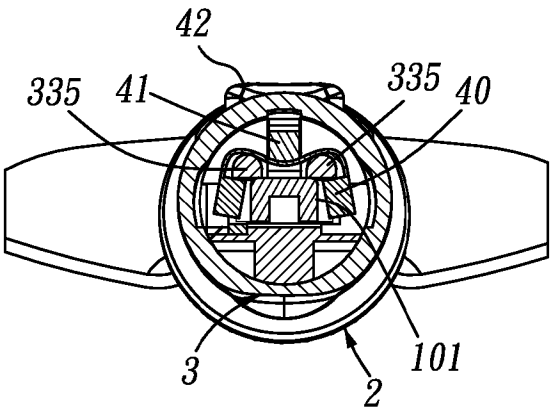
FIG. 7 is a cross-sectional view of the detachable hand tool of the present invention along line 7-7 in FIG. 6.

Referring to FIGS. 4-5 shows an original position of the detachable hand tool in accordance with present invention. When the button 42 is slightly pressed in a first position, as shown on FIGS. 6-7, the protruder 412 of the seesaw 41 is relatively pressed by the button 42 such that the seesaw 41 is pivoted relative to the two pivot holes 334 in the first recess 331 in the spindle 3. The bottom of the seesaw 41 is relatively abutted against the top of the clamp 40. The clamp 40 is elastically deformed due to the two supporters 335 and the seesaw 41 cooperatively compressed the clamp 40 such that the two distal ends of the clamp 40 are outwardly moved relative to each other for releasing the neck 101 of the tool driver 1. The tool driver 1 in the first position is detachable such that a user can pull out the tool driver 1 by hands.

Figure 8:
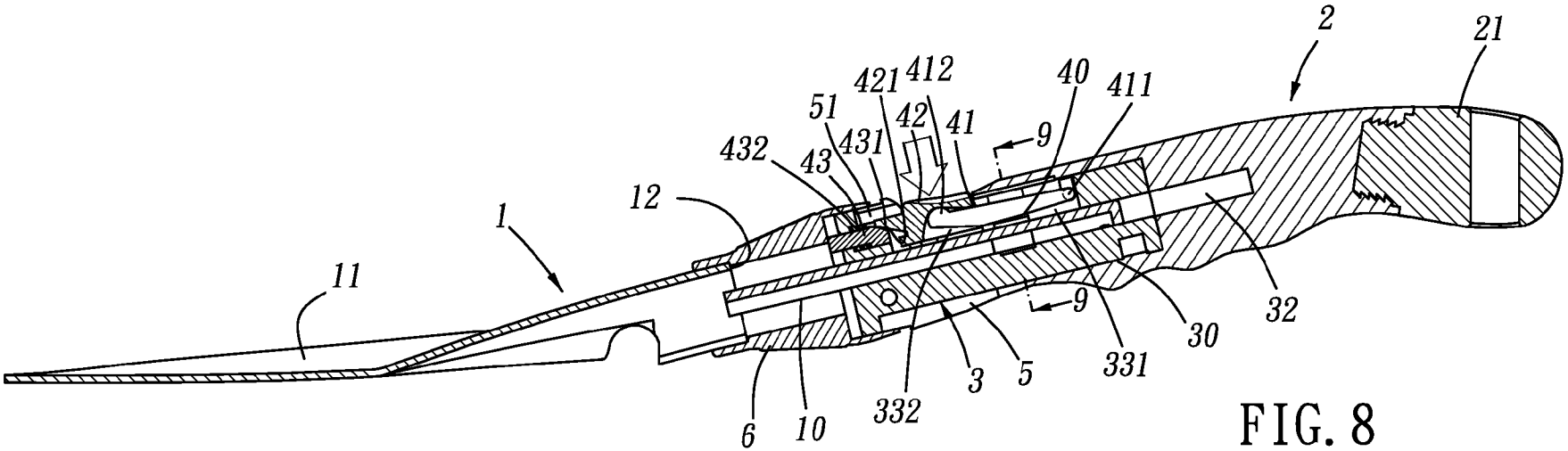
FIG. 8 is a side plane cross-sectional view of the detachable hand tool in a second position in accordance with the present invention.
Figure 9:
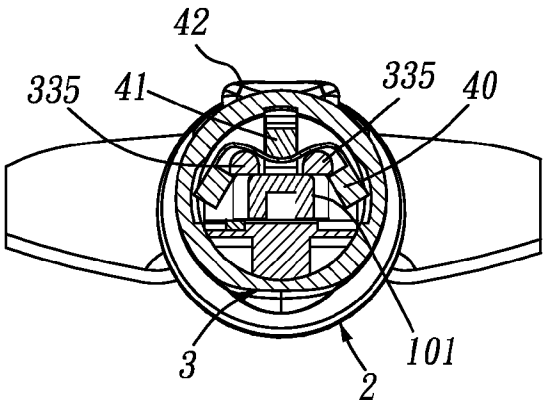
FIG. 9 is a cross-sectional view of the detachable hand tool of the present invention along line 9-9 in FIG. 8.

Referring to FIGS. 8-9, when the button 42 is further deeply pressed in a second position, the slant surface 421 of the button 42 is relatively abutted against the slope 431 of the shank 43. The spring 432 received in the hole 333 is compressed such that the shank 43 is moved relative to the button 42 and protruded from the hole 333 for abutting against the head 6 via the slot 51 in the casing 5. The head 6 is longitudinally moved relative to the casing 5 and relatively abutted against the shoulder 12 of the tool driver 1. The tool driver 1 in the second position is slightly protruded from the groove 32 for helpfully detaching the neck 101 form the clamp 40 such that the user can easily detach the tool driver 1 and replace a new one.

Figure 10:
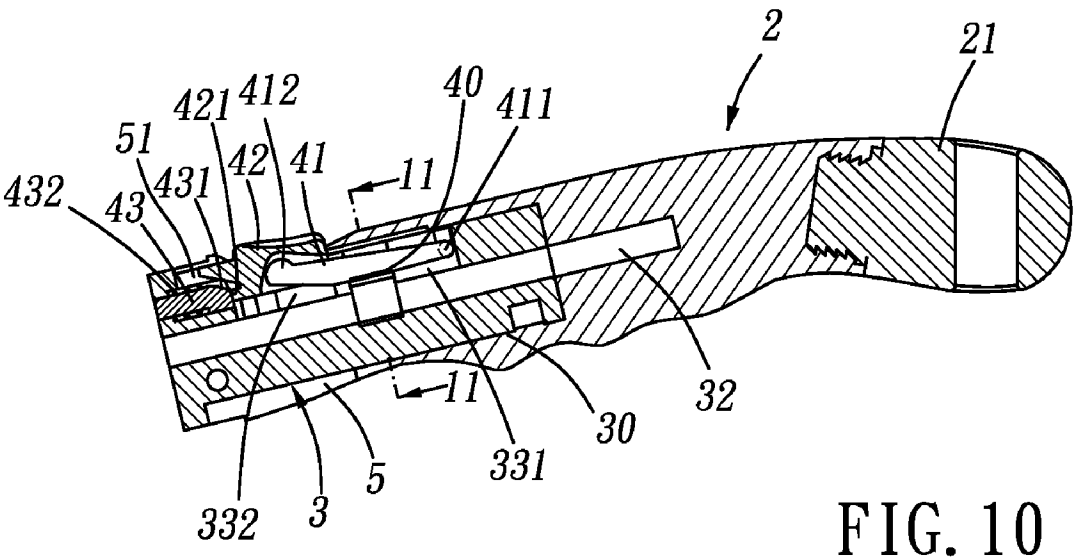
FIG. 10 is a side plane cross-sectional view of the detachable hand tool in a detached position in accordance with the present invention.
Figure 11:
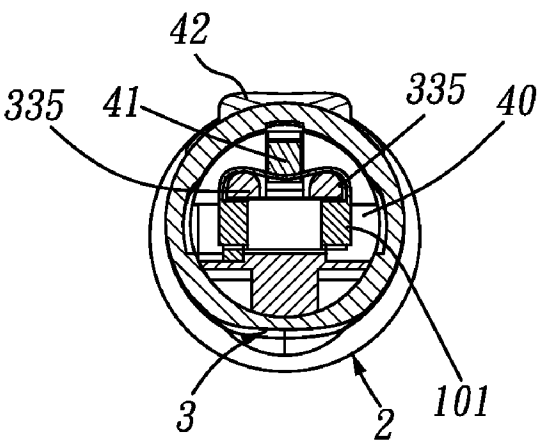
FIG. 11 is a cross-sectional view of the detachable hand tool of the present invention along line 11-11 in FIG. 10.

Referring to FIGS. 10-11, when the tool driver 1 is totally detached from the handle 2 and the button 42 is released, the spring 432 is relatively released to push the shank 43. The shank 43 is relative moved toward the button 42 such that the slope 431 of the shank 43 is abutted against the slant surface 421 of the button 42 for relatively moving the button 42 retained to the original position. The clamp 40 is released and elastically pushed the seesaw 41 pivotally retained to the original position.

Although the invention has been explained in relation to its preferred embodiment, it is to be understood that many other possible modifications and variations can be made without departing from the spirit and scope of the invention as hereinafter claimed.

What is claimed is:

1. A detachable hand tool comprising:

a hollow handle;

a spindle having a first end partially received in the handle and a second end opposite to the first end, the spindle having a groove longitudinally defined therein, the spindle having a first recess laterally defined therein and a second recess defined therein, the second recess being adjacent to the first recess;

a control assembly including:

an elastic clamp mounted on the spindle and positioned between the first recess and the second recess;

a seesaw pivotally received in the first recess and extending to the second recess, the seesaw mounted on the clamp and abutted against a top of the clamp;

a button partially received in the second recess and having a bottom abutted against the seesaw; and a shank partially received in the second recess and abutted by the button, the shank selectively protruded from the spindle;

a tool driver having a neck formed thereon for corresponding to the clamp, the tool driver detachably plugged into the groove in the spindle and the neck locked by the clamp for fixing the tool driver in the spindle;

wherein when the button is slightly pressed in a first position, the button is relatively abutted against the seesaw which is pivoted to abut against the top of the clamp such that the clamp is elastically deformed for releasing the tool driver;

when the button is deeply pressed in a second position, the button is relatively abutted against the shank to push the tool driver such that the tool driver is slightly protruded from the groove for detaching the neck from the clamp.

2. The detachable hand tool as claimed in claim 1, wherein the spindle has a hole longitudinally defined therein and being adjacent to the groove, the control assembly having a spring compressively received in the hole, the shank mounted on the spring for selectively protruding from the hole to push the tool driver.

3. The detachable hand tool as claimed in claim 1, wherein the first recess has two pivot holes respectively defined in two inner lateral sides thereof, one end of the seesaw having two pivots disposed on two sides thereof which are correspondingly received in the two pivot holes in the first recess, the other end of the seesaw having a protruder formed thereon for abutting against the bottom of the button.

4. The detachable hand tool as claimed in claim 1, wherein the shank has a slope formed thereon and the button has a slant surface for correspondingly abutting against the slope of the shank.

5. The detachable hand tool as claimed in claim 1 further comprising a casing partially sleeved on the second end of the spindle, a cutout laterally defined in one end of the casing for receiving the button, the other end of the casing having a slot longitudinally defined therein for receiving the shank protruding from the spindle.

6. The detachable hand tool as claimed in claim 5, wherein the other end of the casing has a shoulder annularly formed on an outer periphery thereof, a head having one end longitudinally movably sleeved on the shoulder of the casing and the other end abutted against the tool driver, the shank selectively abutted against the head via the slot in the casing to relatively push the tool driver.

7. The detachable hand tool as claimed in claim 1 further comprising two supporters disposed between the first recess and the second recess, the clamp having a M-shaped structure transversely covering the two supporters, the clamp having two distal ends positioned under two supporters.

* * * * *